United States Patent [19]

Stahlecker

[11] 4,078,372

[45] Mar. 14, 1978

[54] ARRANGEMENT OF A THREAD MONITOR AT SPINNING STATIONS OF AN OPEN-END SPINNING MACHINE

[75] Inventor: Fritz Stahlecker, Josef-Neidhartstrasse 18, 7341 Bad Uberkingen, Germany

[73] Assignees: Fritz Stahlecker; Hans Stahlecker, both of Germany

[21] Appl. No.: 722,030

[22] Filed: Sep. 10, 1976

[30] Foreign Application Priority Data

Sep. 10, 1975 Germany ..... 2540261

[51] Int. Cl.[2] ..... D01H 13/04; D01H 13/16

[52] U.S. Cl. ..... 57/81; 57/106; 57/109; 242/157.1

[58] Field of Search ..... 57/34 R, 80–81, 57/106, 109, 110; 242/157 R, 157.1

[56] References Cited

U.S. PATENT DOCUMENTS

| | | | |
|---|---|---|---|
| 2,491,569 | 12/1949 | Lichtenberg | 57/34 R |
| 3,719,036 | 3/1973 | Preisser | 57/106 |
| 3,760,576 | 9/1973 | Le Chatalier et al. | 57/34 R |
| 3,911,657 | 10/1975 | Bell et al. | 57/34 R |
| 3,945,183 | 3/1976 | Laudwehrkamp et al. | 57/34 R |

*Primary Examiner*—Richard C. Queisser
*Assistant Examiner*—Charles Gorenstein
*Attorney, Agent, or Firm*—Craig & Antonelli

[57] ABSTRACT

An improved thread monitoring arrangement for open-end spinning machines is provided. A traverse rod extending along a plurality of open-end spinning stations carries individual thread monitors, moveable therewith, for monitoring thread breakage at each of the respective stations. The thread monitors and traverse rod are disposed intermediate the spinning stations and take-off rolls, and are disposed and configured for accommodating thread-piecing operations without requiring movement of the thread monitors.

10 Claims, 3 Drawing Figures

ARRANGEMENT OF A THREAD MONITOR AT SPINNING STATIONS OF AN OPEN-END SPINNING MACHINE

BACKGROUND AND SUMMARY OF THE INVENTION

This invention relates to an arrangement of a thread monitor at spinning stations of an open-end spinning machine containing a plurality of spinning stations, each of which spinning station is equipped with a thread monitor in each case, as seen in the take-off direction of a spun thread, after a thread take-off duct in the zone of take-off rolls.

It has been contemplated to locate a thread monitor, which interrupts the sliver feed in case of a thread breakage, directly at the exit of the thread take-off duct. This arrangement of the thread monitor causes difficulties if an automatic piecing operation is to be carried out after a thread has broken especially by means of a piecing device which can be moved along the open-end spinning machine. During this piecing operation, a thread end is returned via the thread take-off duct into the spinning rotor, attached to a fiber ring deposited at that point, and then taken off again. Care must be taken that, on the one hand, the thread monitor does not impede the return of the thread end, while, on the other hand, the return of the thread end must with certainty be effectd so that the thread, after being taken off again, lies on the correct side of the thread monitor.

In a conventional type of construction (German Pat. No. 2, 012, 108), a thread transfer gripper is designed in a special way for conducting the return of the thread end to the yarn take-off duct for a piecing operation. The thread transfer gripper is provided with an additional drive mechanism providing a relative movement with respect to the thread monitor and the thread take-off duct. Besides, an additional thread-guiding means is arranged at the transfer gripper, intended for a correct threading of the end of the yarn. These provisions considerably increase the structural expenditure for the piecing device. Furthermore, additional error sources are thereby created.

It has also been contemplated to dispose a thread monitor in the take-off direction of the spun thread directly in front of take-off rolls (DOS German Unexamined Laid-Open Application 2, 133, 135), so that thereby the region of the thread take-off duct can remain unimpeded. In this type of structure, no consideration is given to the fact that the spun thread should already change (reverse) in the zone of the take-off rolls, to prevent a premature wear and tear of the take-off rolls. However, such a changing step would mean that the spun thread would migrate by the same or a similar magnitude on the sensor of the thread monitor, so that the sensor of the thread monitor, customarily fashioned as a one-armed lever, is placed under differing loads. This would lead to differing response times in case of thread breaks, so that in certain cases different initial conditions prevail for a subsequent piecing operation, which can render the piecing step substantially more difficult.

The present invention contemplates arranging a thread monitor at a spinning station so that, on the one hand, the function of a piecing device is not impaired or made difficult while, on the other hand, the thread monitor is located in a zone having an exactly defined thread course.

In preferred embodiments of the invention, the thread monitors of the spinning stations are arranged on a traverse (reversing) rod which is located in front of the take-off rolls, as seen in the take-off direction of the spun thread. This arrangement has the result that the thread monitor is disposed in a zone wherein it does not impede the piecing operation, on the one hand, and executes concomitantly the desired traversing (changing, reversing) motion, on the other hand, so that the thread will constantly contact the same point of the sensor of the thread monitor. Any inaccuracies in the functioning of the thread monitor are thereby thus avoided.

These and other objects, features and advantages of the present invention will become more apparent from the following description when taken in connection with the accompanying drawings, which show, for purposes of illustration only, a single embodiment in accordance with the present invention.

DETAILED DESCRIPTION OF THE DRAWINGS

Figure 1:
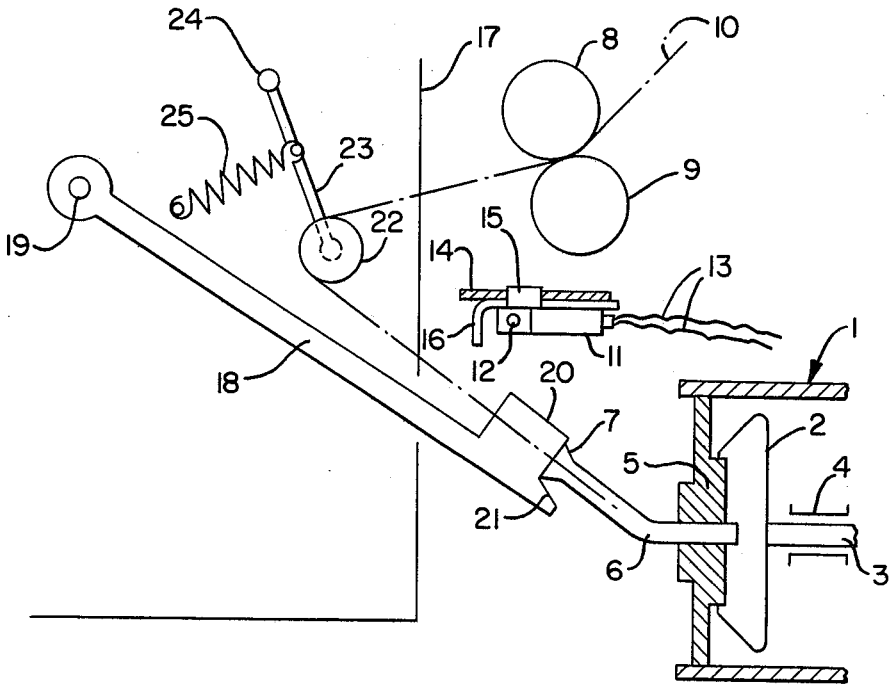
FIG. 1 is a schematic part-sectional view which shows the arrangement of a thread monitor in the zone of take-off rolls of a spinning station and a transfer gripper of a movable piecing device associated with the same spinning station in accordance with a preferred embodiment of the present invention.

Throughout the various views, like reference numerals are utilized to designate like structure. The spinning station 1 of an open-end spinning machine, illustrated only schematically in FIG. 1 and formed from a plurality of identical spinning stations, comprises a spinning turbine 2, the shaft 3 of which is supported in bearings 4. The spinning station 1 is sealed on the front side with a lid 5, from which extends a thread take-off duct 6 which flares in the manner of a funnel at its external mouth 7. The thread, not shown, which exits from the thread take-off duct 6 while the machine is in operation, is taken off by a pair of take-off rolls 8,9, constituted in the illustrated embodiment by a shaft 9 continuously extending in the longitudinal direction of the machine and of pressure rolls 8 arranged at each spinning station 1.

A conventional piecing device 17 can be moved along the open-end spinning machine; only the contours of this device 17 being illustrated. At a certain point in time, during the piecing step, the thread to be pieced assumes the thread course (path) 10, wherein it is held partially by the thread take-off duct 6, and the pair of take-off rolls 8,9, as well as by components of the movable piecing device 17. In the operating condition, the course of the thread is monitored by a thread monitor 11 which is circumvented during the piecing step by means of a thread guide. Such thread monitors 11, disposed at each spinning station 1, each comprise a thread sensor 12 (see also FIG. 2) which is placed under load by the spun thread and is moved into the operating position. These thread monitors are coupled with electric lines 13 in a manner not illustrated in detail by means of a coupling mechanism which operates preferably electromagnetically and cuts off the feeding of the sliver in case of a thread breakage.

Figure 2:
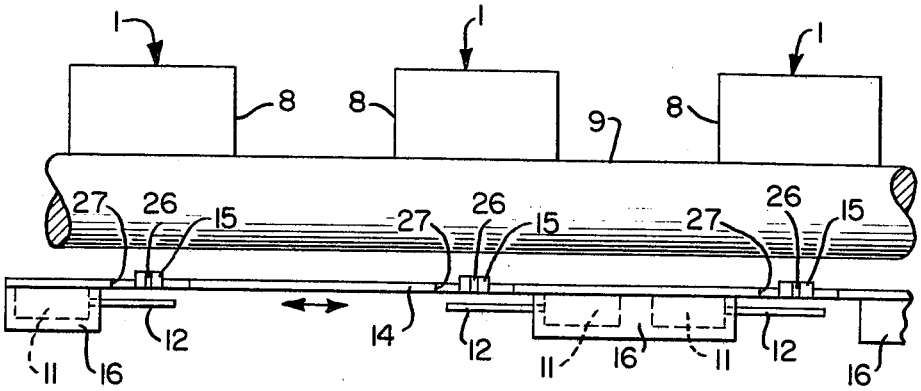
FIG. 2 is a schematic view, taken in a plane perpendicular to the plane of FIG. 1 and showing several spinning stations.

As can be seen in FIGS. 1 and 2, the thread monitor 11 is mounted with the thread sensor 12 to a traverse rod 14 with the interposition of a cover plate 16. This traverse rod 14 reciprocates in the direction of the double arrow of FIG. 2 and takes care of gradually deflecting the thread somewhat along the nip line of the take-off roll pair 8,9, so that the wear on the roll surfaces remains at a low value. An eye 15 is arranged at the traverse rod 14 at each spinning station 1 in which the supplied thread moves along in the operating condition. The thread monitor 11, arranged below the traverse rod 14, i.e. in front of the eye 15 in the take-off direction of the spun thread, is well shielded toward the outside, so that the danger of damage is avoided.

During the piecing step, the zone of the traverse rod 14 is circumvented by the thread 10 to be pieced. This thread 10 is passed through the thread eye 15 only after having been attached to a fiber ring and while it is again being taken off. For this purpose, the traverse rod 14 has guide surfaces 27 leading to the slot 26 of the thread eye 15 (see especially FIG. 3). The thread sensors 12, pertaining to the thread monitors 11, are suitably constructed so that they clearly cover the zone of the guiding surfaces.

Only a few components of the movable piecing device 17 are illustrated in order not to obscure the invention. This piecing device comprises a transfer gripper 18 pivotable about an axle 19, which gripper can contact the mouth 7 of the thread take-off duct 6 with a guide means 21. In the zone 20 of the transfer gripper 18, the thread 10 to be pieced is held in a manner not illustrated in detail. The functional elements for the return of the thread and the subsequent take-off have been omitted, since they are not essential to an understanding of the present invention. It can furthermore be seen that the thread 10, in its illustrated position, is guided by a deflector roll 22 pivotable about an axle 24, a lever 23 carrying the deflector roll 22 being under the effect of a tension spring 25. The control elements for actuation of the pivoting motion of the lever 23 are not illustrated. After the piecing step is terminated, the thread 10 can leave the region of the deflector roll 22 in a manner not shown in the drawings. The thread then passes into the zone of the guide surfaces 27 of the traverse rod 14 and is introduced thereby into the slot 26 of the thread eye 15, during which step it contacts the thread sensor 12 and entrains same.

Figure 3:
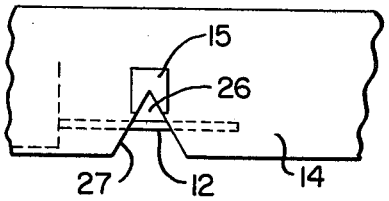
FIG. 3 is an enlarged view of a portion of the arrangement of FIGS. 1 and 2.

Since the thread monitor 11 and thus also the thread sensor 12 are attached to the traverse rod 14, the spun thread always contacts an identical point of the thread sensor 12, once it has passed into the eye 15. Since the thread sensor 12, as can be seen clearly in FIG. 3, is arranged to be markedly set back with respect to the front edge of the traverse rod 14, the disadvantage is excluded with certainty that the thread transferred by the piecing device 17 to the traverse rod 14 can pass to the wrong side of the thread sensor 12. In order to still further enhance the alignment to a specific contact point of the thread on the thread sensor 12, the provision can also be made according to the invention to bend the thread sensor 12 at an angle in the same manner as the notch formed by the guide surfaces 27.

FIG. 2 furthermore shows that a cover plate 16 can cover several thread monitors 11, especially if the sensors 12 thereof point alternatingly toward the left at one spinning station and toward the right at the next spinning station. Of course, arrangements are also contemplated wherein all of the thread sensors 12 are disposed in the same manner, i.e. pointing in one direction.

Since many spinning machines already utilize a traverse rod, similar to rod 14 of the preferred illustrated embodiment of this invention, this invention advantageously avoids the need for additional expenditures by utilizing such existing structure.

While we have shown and described only a single embodiment in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

I claim:

1. Spinning machine apparatus comprising:

at least one spinning station, thread take-off means for assisting in taking off and guiding spun thread being spun at said spinning station, said thread take-off means including take-off rolls between which said thread passes, traverse rod means interposed between said spinning station and said thread take-off means, said traverse rod means being sequentially movable back and forth to accommodate even distribution of thread wear on said take-off rolls, and thread monitor means carried by said traverse rod means and including means for monitoring the thread and for initiating stoppage of the supply of sliver to said spinning station in response to a detected thread breakage.

2. Spinning machine apparatus according to claim 1, wherein a plurality of spinning stations are provided, and wherein a plurality of said thread monitor means are carried by said traverse rod means, one for each of said spinning stations.

3. Spinning machine apparatus according to claim 1, wherein said thread monitor means includes lever means forced into a first position by said thread passing thereover, said lever means being moveable to a second position in the absence of said thread.

4. Spinning machine apparatus according to claim 3, wherein a plurality of spinning stations are provided, and wherein a plurality of said thread monitor means carried by said traverse rod means, one for each of said spinning stations.

5. Spinning machine apparatus according to claim 4, wherein each of said thread monitor means includes a thread sensor engageable with thread passing from the respective spinning station to the respective take-off rolls, wherein said traverse rod means is provided with a set of guide surfaces in the zone of each thread sensor, and wherein said guide surfaces are directed toward respective thread guide eyes mounted on the traverse rod means.

6. Spinning machine apparatus according to claim 5, wherein each of said thread monitor means is covered up to the zone of its thread sensor with profile means attached to the traverse rod means.

7. Spinning machine apparatus according to claim 3, wherein said thread monitor means are covered up to the zone of their lever means with profile means attached to the traverse rod means.

8. Spinning machine apparatus according to claim 1, wherein said thread monitor means includes a thread sensor engageable with thread passing from the spinning station to the thread take-off means, wherein said traverse rod means is provided with thread guide surfaces in the zone of the thread sensor, and wherein said guide surfaces are directed toward a thread guide eye mounted on the traverse rod means.

9. Spinning machine apparatus according to claim 8, wherein a plurality of spinning stations are provided, and wherein a plurality of said thread monitor means carried by said traverse rod means, one for each of said spinning stations.

10. Spinning machine apparatus according to claim 8, wherein said thread monitor means is covered up to the zone of the thread sensor with profile means attached to the traverse rod means.

* * * * *